US008049628B2

(12) United States Patent
Arrighi

(10) Patent No.: US 8,049,628 B2
(45) Date of Patent: Nov. 1, 2011

(54) CONTAINER-INSERTABLE ANTI-THEFT DEVICE

(75) Inventor: Robert Arrighi, Maplewood, NJ (US)

(73) Assignee: Union Tool & Mold Company, Maplewood, NJ (US)

( * ) Notice: Subject to any disclaimer, the term of this patent is extended or adjusted under 35 U.S.C. 154(b) by 329 days.

(21) Appl. No.: 12/386,864

(22) Filed: Apr. 25, 2009

(65) Prior Publication Data

US 2010/0270320 A1 Oct. 28, 2010

(51) Int. Cl.
*G08B 13/14* (2006.01)

(52) U.S. Cl. ..... 340/572.8; 340/572.1

(58) Field of Classification Search ..... 340/572.8, 340/572.1, 572.9
See application file for complete search history.

(56) References Cited

U.S. PATENT DOCUMENTS

| | | | | |
|---|---|---|---|---|
| 5,717,382 | A | 2/1998 | Cooper | |
| 5,949,336 | A | 9/1999 | Deschenes et al. | |
| 6,064,306 | A | 5/2000 | Deschenes et al. | |
| 6,067,016 | A | 5/2000 | Deschenes et al. | |
| 6,137,413 | A * | 10/2000 | Ryan, Jr. | 340/572.8 |
| 6,342,838 | B1 * | 1/2002 | Kolton et al. | 340/572.1 |
| 6,488,531 | B1 | 12/2002 | Kolton et al. | |
| 6,518,888 | B1 | 2/2003 | Kolton et al. | |
| 6,543,261 | B2 | 4/2003 | Kolton et al. | |
| 6,567,003 | B2 | 5/2003 | Kolton et al. | |
| 6,589,067 | B1 | 7/2003 | Kolton et al. | |
| 6,646,553 | B1 | 11/2003 | Kolton et al. | |
| 6,696,955 | B2 | 2/2004 | Kolton et al. | |
| 6,753,779 | B1 | 6/2004 | Kolton et al. | |
| 6,882,277 | B2 | 4/2005 | Kolton et al. | |
| 6,899,252 | B2 | 5/2005 | Logan et al. | |
| 6,932,251 | B2 | 8/2005 | Kolton et al. | |
| 6,933,847 | B2 | 8/2005 | Feibelman | |
| 6,987,455 | B2 | 1/2006 | Kolton et al. | |
| 7,005,989 | B2 | 2/2006 | Benoit et al. | |
| 7,012,526 | B2 | 3/2006 | Kolton et al. | |
| 7,095,327 | B2 | 8/2006 | Kolton et al. | |
| 7,129,841 | B2 | 10/2006 | Feibelman | |
| 7,183,914 | B2 | 2/2007 | Norman et al. | |
| 7,183,927 | B2 | 2/2007 | Kolton et al. | |
| 7,227,467 | B2 | 6/2007 | Feibelman | |
| 7,436,301 | B2 * | 10/2008 | Norman et al. | 340/572.8 |
| 7,586,417 | B2 * | 9/2009 | Chisholm | 340/572.8 |
| 2006/0145873 | A1 | 7/2006 | Feibelman et al. | |
| 2006/0187039 | A1 * | 8/2006 | Bui et al. | 340/572.1 |

* cited by examiner

*Primary Examiner* — John A Tweel, Jr.
(74) *Attorney, Agent, or Firm* — Deirdra Meagher, Esq.; Bradford Bondor, Esq.

(57) ABSTRACT

A container-insertable anti-theft device includes: a main housing containing an electronic article surveillance marker, the main housing being waterproof; and at least one elongated protrusion extending from the main housing, the elongated protrusion being flexible and having a length equal to at least the longest dimension of the main housing. There is also an anti-theft system that includes: (a) a container for strong flowable material having a hollow main body, a pour orifice and a closure for the pour orifice, the container having a maximum internal diagonal dimension x; and (b) a container-insertable anti-theft device that includes: a main housing containing an electronic article surveillance marker, the main housing being waterproof and having a predetermined length y; and, at least one elongated protrusion, the elongated protrusion being flexible and having a length, wherein the sum of the lengths y and y are greater than x, such that the container-insertable anti-theft device may be flexed and force-fitted into a maximum internal diagonal of the container, locking it therein so as to deter easy removal therefrom.

19 Claims, 6 Drawing Sheets

CONTAINER-INSERTABLE ANTI-THEFT DEVICE

BACKGROUND OF INVENTION a. Field of Invention

The invention relates generally to a container-insertable anti-theft device that relies on a combination of an EAS (Electronic Article Surveillance) marker (sometimes referred to as an anti-theft tag) and a structure that allows insertion of the device into a container but that inhibits its removal from the container, once it has been inserted. Thus, the device prevents theft by way of the anti-theft tag, and further prevents theft by making it extremely difficult for a would-be thief to remove the tag and steal the product without activating an alarm. The present invention tag may be used in any container with flowable material, such as liquid or powder detergents, motor oil, cooking oil, salt, ganular chemicals, foods and home products, etc.

b. Description of Related Art

The following patents are representative of the field pertaining to the present invention:

U.S. Pat. No. 7,227,467 B2 to Feibelman describes an anti-theft security tag that includes an engagement member having a first and second end that is securable within a housing by a crimping member for attachment to an article. In one embodiment, the housing supports an electronic article surveillance marker and may include a channel for receiving and securing at least one self-crimping member. The self-crimping member is sized to receive one end of the engagement member. The one or more crimping members may be disc shaped, including a plurality of fingers for securing one end of the engagement member, or may have a variety of other shapes. The self-crimping members allow the engagement member to be moved downward, but not upward, so as to make the engagement loop smaller. In another embodiment, the crimping member is manual and a slot is disposed within the housing in alignment with at least one crimping member, and is sized to receive a crimping tool to crimp the member and secure the line to the article within the housing.

U.S. Pat. No. 7,183,927 B2 to Kolton et al. describes an electronic surveillance assembly that comprises a housing containing an electronic article surveillance marker, the housing defining a viewability channel extending between opposed first and second exterior surfaces of the housing, the electronic article surveillance marker being disposed aside the viewability channel. In a combination, there is provided an article of manufacture and an electronic article surveillance assembly comprising a housing containing an electronic article surveillance marker, the housing defining a viewability channel extending between opposed first and second exterior surfaces of the housing, the electronic article surveillance marker being disposed aside the viewability channel, the article of manufacture having a bottom portion thereof disposed in the housing in registry with the viewability channel.

U.S. Pat. No. 7,183,914 B2 to Norman et al. decribes a hang tag which provides for the accommodation of electronic article surveillance (EAS) marker. The hang tag includes a housing for supporting the EAS marker therein. A securement head is provided for accommodating a securement strap for coupling the housing to an article that is to be protected. The head is coupled to the housing in such a fashion that it permits continuous rotation with respect to the housing to thwart and attempt to improperly sever the securement strap from the article.

U.S. Pat. No. 7,129,841 B2 to Feibelman describes an adjustable anti-theft security tag that includes an engagement member having a first and second end securable within a housing for attachment to an article. The housing supports an electronic article surveillance marker and may include one or more channels for receiving and securing at least one stationary crimping member. The at least one stationary crimping member is sized to receive one end of the engagement member. The one or more crimping members may be disc shaped, including a plurality of fingers for securing one end of the engagement member, or may be tubular. The disc shaped members allow the engagement member to be moved downward, but not upward, so as to make the engagement loop smaller. In one embodiment, a slot is disposed within the housing in alignment with the at least one crimping member, and is sized to receive a crimping tool to crimp the member and secure the line to the article within the housing.

U.S. Pat. No. 7,095,327 B2 to Kolton et al. describes an electronic article surveillance assembly that comprises an upstanding housing having a closed ceiling and a floor having continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section. Further provided is, in combination, an electronic article surveillance assembly comprising an upstanding housing having a closed ceiling and a floor having a continuous peripheral portion bounding a central floor opening, the housing having an interior cavity communicating with the central floor opening, an EAS marker being disposed in the housing interior cavity, the housing defining a sidewall extending from the ceiling to the continuous peripheral floor portion and tapered to form the housing with a periphery having a V-shaped cross-section and an article of manufacture, the continuous floor peripheral portion being secured to an exterior surface of the article manufacture.

U.S. Pat. No. 7,012,526 B2 to Kolton et al. described an EAS marker assembly that comprises a housing defining a cavity extending inwardly from an open wall of the housing and a passage extending through a closed wall of the housing opposite the open wall and disposed aside the cavity and an EAS marker secured to the closed wall of the housing. A securement member extends through the passage and secures the EAS marker assembly to an article of manufacture, the article of manufacture closing the open wall of the housing.

U.S. Pat. No. 7,005,989 B2 to Beniot et al. describes an EAS marker, in one embodiment, comprises a self-lockable loop fastener. The self-lockable loop fastener comprises an elongated strap having a first end and a second end, the second end being provided with a plurality of teeth. The self-lockable loop fastener also comprises a paddle disposed at the first end of the strap. The paddle includes a recess and a locking head. The second end of the strap is insertable into, but not through the locking head, the locking head having a tang for lockably engaging the teeth in such a way as to prevent withdrawal of the strap from the locking head and thereby forming a locked loop of fixed size. The EAS marker also includes a resonator disposed within the recess of the paddle for emitting, when armed, a response signal in response to an interrogation signal transmitted by an EAS system, a biasing element disposed within the recess and positioned relative to the resonator so that, when the biasing element is magnetized, the resonator is armed; a separator disposed within the recess between the resonator and the biasing element; and a cover secured to the paddle to encapsulate the resonator, the separator and the biasing element within the recess and to prevent access to and tampering with the tang and the locking head.

U.S. Design Pat. No. 6,987,455 B2 to Kolton et al. describes an assembly which includes an article of manufacture having an exterior surface of a given color and an EAS marker-containing housing secured to the article and defining an exterior surface of the given color. Another assembly includes an article of manufacture having an exterior surface with a surface section of a given configuration and an EAS marker-containing housing secured to the article and defining an exterior surface having surface section contiguous with the article surface section and of the given configuration.

U.S. Design Pat. No. 6,933,847 to Feibelman describes an anti-theft security tag that includes an engagement member having a first and second end securable within a housing for attachment to an article. The housing supports an electronic article surveillance marker and may include one or more channels for receiving and securing at least one crimping sleeve. The at least one crimping sleeve is sized to receive one end of the engagement member. A slot is disposed within the housing in alignment with the at least one crimping sleeve, and is sized to receive a crimping tool to crimp the sleeve and secure the wire to the article within the housing.

U.S. Pat. No. 6,932,251 B2 to Kolton et al. describes a hanger that has a support rod engaging portion, a garment supporting portion extending downwardly of the support rod engaging portion and a size marker receiving portion opening into the periphery of the hanger, the hanger defining in the size marker receiving portion at least one deflectable size marker retaining member. A size marker for assembly with a hanger includes a rigid body defining a ceiling and front and rear walls extending downwardly of the ceiling to a floor, at least one passage opening into the floor and extending between the front and rear walls, the recess communicating with the passage at an upper portion thereof.

U.S. Pat. No. 6,899,252 B2 to Logan et al. describes a separator that is insertable into a medicine container and thereupon defining upper and lower compartments in the medicine container, the separator having a separating portion pivotally supported for movement into a first position for forming the upper and lower compartments and into a second position providing access to the lower compartment, the separator including latching structure for releasably maintaining the separator portion in the first position.

U.S. Pat. No. 6,882,277 B2 to Kolton et al. describes an EAS marker assembly that comprises of a housing defining an interior cavity and an EAS marker contained in the housing interior cavity, the housing defining first and second tabs extending outwardly of the housing, each of the first and second tabs defining an aperture extending therethrough. The EAS marker assembly is assembled with an article of manufacture defining first and second apertures extending therethrough, the EAS marker assembly being arranged in combination with the article of manufacture such that the apertures of the first and second tabs are aligned with the first and second apertures of the article of manufacture and a joinder device extending through the apertures of the first and second tabs and the first and second apertures of the article of manufacture and securing the EAS marker assembly to the article of manufacture.

U.S. Pat. No. 6,753,779 B1 to Kolton et al describes an electronic article surveillance assembly that comprises a housing defining an interior compartment, an electronic article surveillance marker secured in the interior compartment, and a securement device insertable in the housing and having securement structure extending outwardly of the housing for attaching the housing to an article of manufacture.

U.S. Pat. No. 6,696,955 B2 to Kolton et al. describes an EAS marker assembly that comprises a housing defining an interior cavity and an EAS marker and a weighting member disposed in the housing interior cavity, the weighting member being of a composition which does not interfere with operation of the EAS marker. A container has an inlet/outlet pot and an EAS marker assembly is configured to be passable through the inlet/outlet port into an interior of the container and thereupon to expand to a dimension exceeding a dimension of the container inlet/outlet port, the EAS marker assembly including therein a weighting member.

U.S. Pat. No. 6,646,553 B1 to Kolton et al. describes an electrical article surveillance marker assembly that comprises a housing containing an EAS marker and a strap member having a detent structure at one end thereof and a tail extending from the detent structure to a free end, one side of the tail defining ratchet structure retainable by the detent structure, the detent structure being retained interiorly of the housing, the tail extending outwardly of the housing through a passage formed in a first wall of the housing, the housing defining an opening in a second wall of the housing in registry with the detent structure, the tail free end being movable through the second wall opening into the detent structure to be retained in the housing.

U.S. Pat. No. 6,589,067 B1 to Kolton et al. describes an electrical cable assembly that includes an electrical cable and an electrical connector connected to the electrical cable has a housing thereon defining a passage therethrough for the electrical cable and opposed housing ends circumscribing the cable, one of the housing ends being in facing relation to the electrical connector. The housing has an EAS member secured therein aside the housing passage. An article surveillance unit has first and second housing members joined to one another and defining a seam line, one of the first and second housing members defining structure overlapping the seam line.

U.S. Pat. No. 6,567,003 B2 to Kolton et al. describes a seal that includes a first housing member defining a recess and detent structure and a tail having an end thereof secured with the first housing member and extending outwardly of the first housing member, the tail having a securement structure at a free end thereof, the tail securement structure being receivable in the detent structure, an EAS marker disposed in the recess and a second housing member having a compartment therein for retentively containing the first housing member.

U.S. Pat. No. 6,543,261 B2 to Kolton et al. describes an EAS marker that contains seal comprises a housing defining an interior recess seating an EAS marker and a latching structure adjacent to an end of the housing. The housing has a flexible tail extending outwardly thereof and the tail defines a plurality of latching apertures. The housing defines an opening distal from each of the latching structure and the recess and of dimensions permitting entry of a free end of the tail into the housing members. The housing further defines an interior channel permitting movement of the tail over and beyond the EAS marker into the interior of the housing.

U.S. Pat. No. 6,518,888 B1 to Kolton et al. describes an EAS marker assembly that includes a housing defining an interior compartment and at least one channel accessible exteriorly of the housing and extending therethrough, an EAS marker contained in the compartment, and at least one securement member having a body portion and first and second leg portions depending from the body portion configured to be jointly insertable in the channel, the body portion and the leg portions defining a cavity closed at one end by the body portion and open at free ends of the leg portions. A combination includes: eyeglasses having a lens holder and first and second temples pivotally secured to the lens holder and at least one clip having a body portion and leg portions depending from the body portion, the body portion defining a cavity, the first temple being resident in the cavity, a housing defining an interior compartment and at least one channel accessible exteriorly of the housing and extending therethrough, the leg portions of the clip being retentively resident in the channel and an EAS member disposed in the compartment.

U.S. Pat. No. 6,488,531 B1 to Kolton et al. describes an electrical cable assembly that includes an electrical cable and an electrical connector connected to the electrical cable has a housing thereon defining a passage therethrough for the electrical cable and opposed housing ends being in facing relation to the electrical connector. The housing has an EAS member secured therein aside the housing passage. An article surveillance unit has first and second housing members joined to one another and defining a seam line, one of the first and second housing members defining structure overlapping the seam line.

U.S. Pat. No. 6,067,016 to Deschenes et al. describes an EAS marker and method of manufacturing it. In a preferred embodiment, the EAS marker comprises a rigid bottom piece of molded plastic having the shape of an open rectangular box. An elongated resonator is disposed in the bottom piece, the resonator being bowed downwardly about its longitudinal axis. A rigid separator of molded plastic is positioned over the open top of the bottom piece, thereby loosely encasing the resonator in the bottom piece. The foregoing bottom piece, resonator and separator are all positioned within the cavity of a rigid top piece of molded plastic having the shape of an inverted open rectangular box, the separator being press-fit against the interior surface of the top wall of the top piece, the bottom piece being press-fit against the interior surfaces of the side walls and end walls of the top piece. The top wall of the top piece is provided with a recessed area in which a biasing element is disposed, the biasing element being retained in the recessed area by the separator. The separator is shaped to include a projection that extends downwardly beyond the remainder of the bottom surface of the separator, the projection being sized and shaped to contact the top of the resonator only within a circular area approximately 0.1 inch in diameter located in approximately the middle of the resonator. The present invention is also directed to an automated method and apparatus for manufacturing the above EAS marker. In a preferred embodiment, each of the top piece, the bottom piece and the separator is manufactured, by rotary extrusion molding, as part of a continuous web, and the various continuous webs are automatically laminated to one another at nips between pairs of rollers.

U.S. Pat. No. 6,064,306 to Deschenes et al. describes a fastener assembly for use in tagging an article of commerce and in detecting the unauthorized removal of the article from a store or other business establishment. The fastener assembly comprises a plastic fastener comprising an elongated filament having a first end and a second end, a transverse bar disposed at the first end of the elongated filament and a paddle disposed at the second end of the elongated filament. The paddle is shaped to include a recess. The fastener assembly also comprises an electronic article surveillance (EAS) security device which is disposed within the recess of the paddle. A cover is mounted over the recess so as to trap the security device within the paddle. A method of manufacturing the fastener assembly can be accomplished by continuously molding a length of fastener stock to form a plastic fastener having a recess former therein, disposing a security device within the recess of the plastic fastener and mounting a cover over the recess so as to trap the security device within the fastener.

U.S. Pat. No. 5,949,336 to Deschenes et al. describes a fastener assembly for use in tagging an article of commerce and in detecting the unauthorized removal of the article from a store or other business establishment. The fastener assembly comprises a plastic fastener comprising an elongated filament having a first end and a second end, a transverse bar disposed at the first end of the elongated filament and a paddle disposed at the second of the elongated filament. The paddle is shaped to include a recess. The fastener assembly also comprises an electronic article surveillance (EAS) security device which is disposed within the recess of the paddle. A cover is mounted over the recess so as to trap the security device within the paddle. A method of manufacturing the fastener assembly can be accomplished by continuously molding a length of fastener stock to form a plastic fastener having a recess formed therein, disposing a security device within the recess of the plastic fastener and mounting a cover over the recess so as to trap the security device within the fastener.

U.S. Pat. No. 5,717,382 to Cooper describes a device for use in detecting the unauthorized removal of an article of commerce from a store or other business establishment. In one embodiment, the device comprises a fastener of the type constructed for use in attaching a tag to the article of commerce. The fastener includes a first end, a second end and a filament interconnecting the first end and the second end. The first end is shaped to define a cross-bar which can be inserted through the tag and then through the article of commerce. The second end is sized and shaped to prevent the tag from being pulled off the filament. The fastener is made of plastic and includes one or more magnetizable particles embedded therewithin. The particles initially placed in a magnetized state. Consequently, when an article, including the fastener, passes through a magnetic field detector, a signal will be emitted unless the particles have been demagnetized.

U.S. Patent Application Publication No. 2006/0145873 A1 to Feibelman et al. describes an anti-theft security tag that includes an engagement member and a housing for supporting an electronic article surveillance (EAS) marker. The housing includes a rotating inner core for supporting the engagement member for attachment to the article. The engagement member includes a line for connection to the article and a locking mechanism for securing the first and second ends of the line therein so that the core and the engagement member can rotate together within the housing. In one embodiment, the locking mechanism includes one or more self-crimping members which automatically secure at least one end of the line upon insertion therein. One end of the rotating core may be disposed flush with one end of the housing, so that the consumer cannot twist the line in order to remove the tag.

Notwithstanding the prior art, the present invention is neither taught nor rendered obvious thereby.

SUMMARY OF INVENTION

The present invention is directed to a container-insertable anti-theft device that includes: a main housing containing an electronic article surveillance marker, the main housing being waterproof; and at least one elongated protrusion extending from the main housing, the elongated protrusion being flexible and having a length equal to at least the longest dimension of the main housing.

In some preferred embodiments of the present invention container-insertable anti-theft device, the at least one elongated protrusion is at least two elongated protrusions. In some preferred embodiments, the two elongated protrusions are connected to one another by a semiflexible or flexible bridge member, while in other embodiments, they are not.

In some preferred embodiments of the present invention container-insertable anti-theft device, there is one elongated protrusion and the one elongated protrusion has a proximal end connected to the main housing and has a distal end positioned away from the main housing, the distal end having at least two at least partially non-parallel segments extending therefrom away from the main housing.

In some preferred embodiments of the present invention container-insertable anti-theft device, the elongated protrusion and the at least two segments are arranged in Y-shape.

In some preferred embodiments of the present invention container-insertable anti-theft device, there are three segments. In some of these preferred embodiments of the present invention container-insertable anti-theft device, the three segments include one segment being a linear extension of and in the same plane as the one elongated protrusion.

In some preferred embodiments of the present invention container-insertable anti-theft device, the elongated protrusion has a length equal to at least twice the longest dimension of the housing.

In some preferred embodiments of the present invention container-insertable anti-theft device, there are at least four elongated protrusions extending from the main housing. In some of these preferred embodiments of the present invention container-insertable anti-theft device, the four elongated protrusions are symmetrically arranged to form a spider catch.

In another embodiment of the present invention, the invention is an anti-theft system that includes: (a) a container for strong flowable material having a hollow main body, a pour orifice and a closure for the pour orifice, the container having a maximum internal diagonal dimension x; and (b) a container-insertable anti-theft device that includes: a main housing containing an electronic article surveillance marker, the main housing being waterproof and having a predetermined length y; and, at least one elongated protrusion, the elongated protrusion being flexible and having a length, wherein the sum of the lengths y and y are greater than x, such that the container-insertable anti-theft device may be flexed and force-fitted into a maximum internal diagonal of the container, locking it therein so as to deter easy removal therefrom.

In some preferred embodiments of the present invention system, that is, the present invention container and container-insertable anti-theft device, the container-insertable anti-theft device at least one protrusion is at least two elongated protrusions.

In some preferred embodiments of the present invention system, that is, the present invention container and container-insertable anti-theft device, there is one elongated protrusion.

In some preferred embodiments of the present invention system, that is, the present invention container and container-insertable anti-theft device, there is one elongated protrusion and the one elongated protrusion has a proximal end connected to the main housing and has a distal end positioned away from the main housing, the distal end having at least two at least partially non-parallel segments extending therefrom away from the main housing.

In some preferred embodiments of the present invention system, that is, the present invention container and container-insertable anti-theft device, the elongated protrusion and the at least two segments are arranged in Y-shape.

In some preferred embodiments of the present invention system, that is, the present invention container and container-insertable anti-theft device, there are three segments.

In some preferred embodiments of the present invention system, that is, the present invention container and container-insertable anti-theft device, the three segments include one segment being a linear extension of and in the same plane as the one elongated protrusion.

In some preferred embodiments of the present invention system, that is, the present invention container and container-insertable anti-theft device, the elongated protrusion has a length equal to at least the longest dimension of the main housing.

In some preferred embodiments of the present invention system, that is, the present invention container and container-insertable anti-theft device, the there are at least four elongated protrusions extending from the main housing. In some of these preferred embodiments of the present invention system, that is, the present invention container and container-insertable anti-theft device, the four elongated protrusions are symmetrically arranged to form a spider catch.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
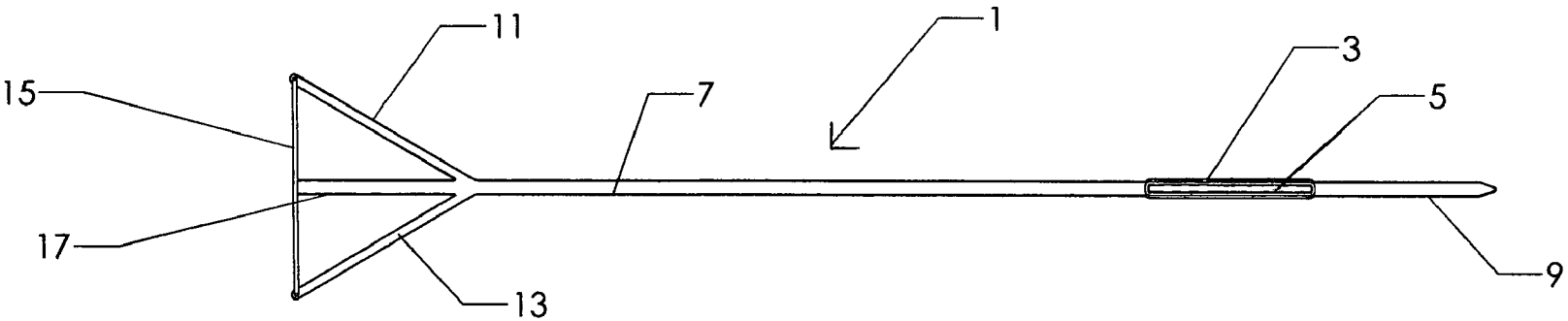
FIG. 1 is a front view of an embodiment of a present invention container-insertable anti-theft device with plural, connected non-parallel segments extending from the distal end of an elongated protrusion.

Referring now in detail to the drawings wherein like reference numerals designate corresponding parts throughout the several views, various embodiments of the present invention are shown. In all embodiments, the protrusions of the present invention anti-theft devices are to be understood to have some flexibility. They could be flexible along their entire lengths, at a single point or along a portion. They are generally made of plastic, but could be made of plastics with metal skeletal structure or made of any flexible material.

Figure 2:
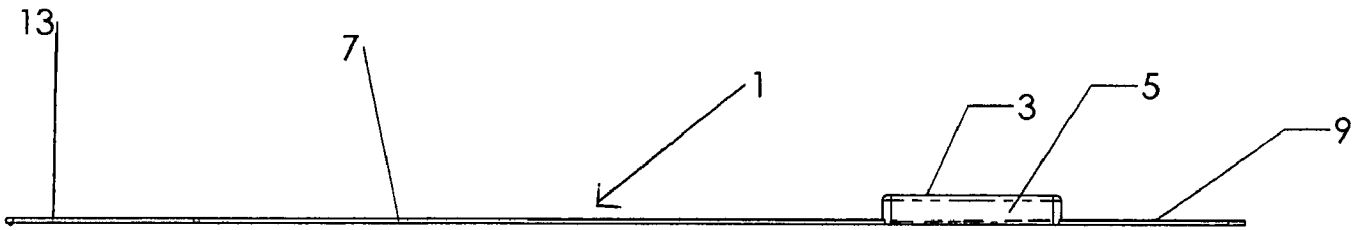
FIG. 2 is a side view of the embodiment of a present invention container-insertable anti-theft device shown in FIG. 1.

FIG. 1 is a front view of an embodiment of present invention container-insertable anti-theft device 1 with plural, connected non-parallel segments 11, 13 and 17 extending from the distal end of an elongated protrusion 7. FIG. 2 is a side view of the embodiment of a present invention container-insertable anti-theft device shown in FIG. 1. FIGS. 1 and 2 are now discussed collectively. There is a main housing 3 that contains any known EAS (electronic article surveillance) security device 5. In some preferred embodiments, especially where the present invention device will be submersed in liquid rather than flowable solids, main housing 5 is hermetically sealed so as to render the EAS operable in and isolated from liquids. Device 1 has elongated protrusion 7 with three connected segments 11, 13, and 17 located in a single plane and connected by connector 15, as shown. Its total overall length is determined by its intended use and in general it should be longer than the inside height and preferably the inside diagonal of the container into which it is to be inserted, so as to bend and force-fit lock into place inside the container. This will provide a manufacturer, seller or other outlet with double anti-theft protection-first, the EAS will sound an alarm if the container is stolen, and second, if the thief tries to beat the EAS alarm system by removing it from the container, the flexed-in-during-insertion and after insertion, popped open device will either be inaccessible to reach or will spread or be too wide for the container mouth if plural segments are used, as here.

Figure 4:
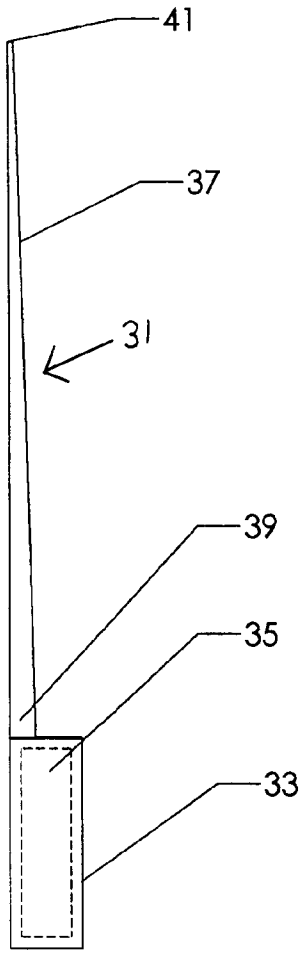
FIG. 4 is a side view of the embodiment of a present invention container-insertable anti-theft device shown in FIG. 3.
Figure 3:
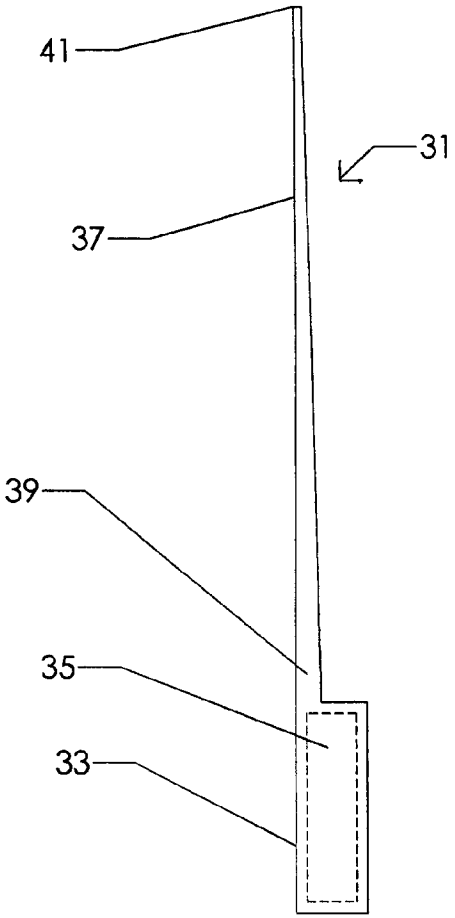
FIG. 3 is a front view of another embodiment of the present invention container-insertable anti-theft device with a single elongated protrusion component.

FIG. 3 is a front view of another embodiment of the present invention container-insertable anti-theft device 31, with a single elongated protrusion component 37. FIG. 4 is a side view of the embodiment of a present invention container-insertable anti-theft device 31 shown in FIG. 3. It includes a main housing 33 with an EAS component 35 contained therein. The proximal end 39 of elongated protrusion extends from the main housing 33 and could be attached or formed therewith as a single part. (The main housing will initially have at least two parts so as to encase the EAS device, and the elongated protrusion 37 could be molded as part of one of those two parts). The distal end 41 will be used to lodge into an inside corner of a container.

Figure 5:
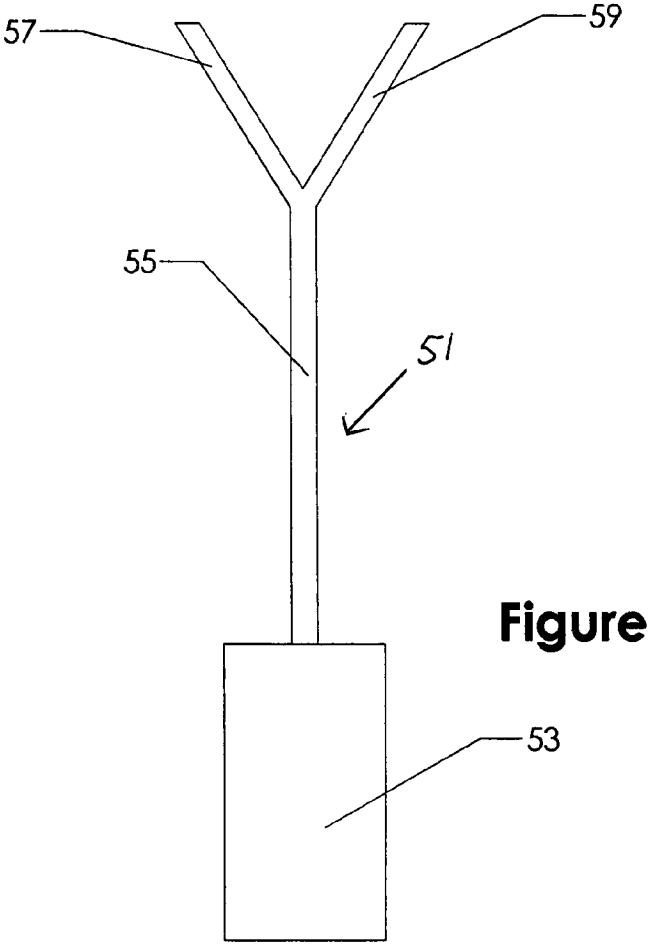
FIG. 5 is a front view of another embodiment of the present invention container-insertable anti-theft device with a single elongated protrusion terminating in dual segments creating a Y-shaped device.

FIG. 5 is a front view of another embodiment of the present invention container-insertable anti-theft device 51 with a single elongated protrusion 55 extending from an EAS component 53 and terminating in dual segments 57 and 59 creating a Y-shaped device.

Figure 6:
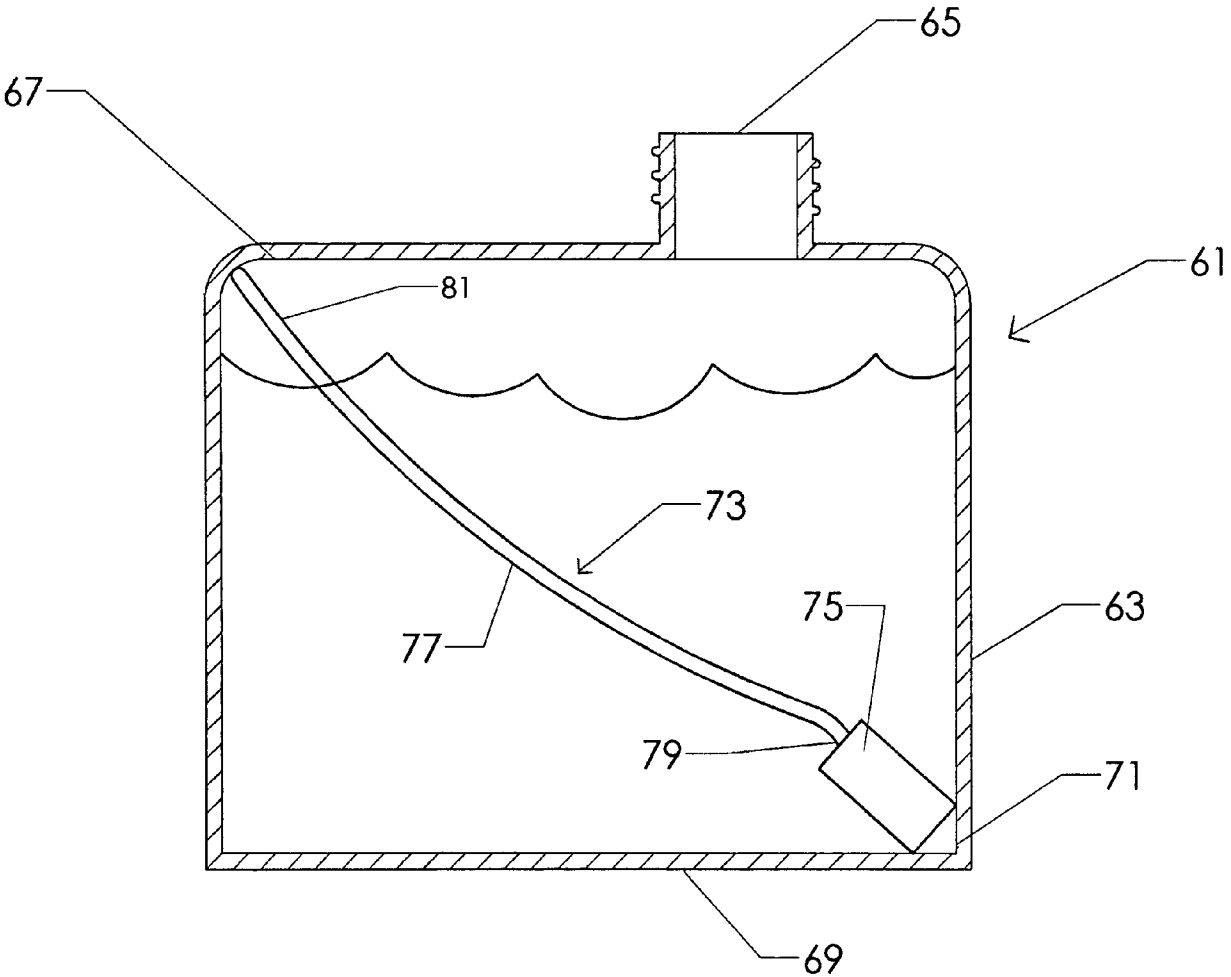
FIG. 6 is a cut front view of another embodiment of the present invention, in this case, a present invention system with a container and a container-insertable anti-theft device inserted therein.

FIG. 6 is a cut front view of another embodiment of the present invention, in this case, a present invention system with a container 61 and a container-insertable anti-theft device 73 inserted therein. Container 61 has sidewalls 63, bottom 69 and dispensing opening 65. Device 73 has a main housing 75 with an encased EAS element and extending from its top 79 is protrusion 77. The device 73 has been inserted manually, automatically (by automation) or manually with a tool and it has been lodged at its bottom in corner 71 of container 61 and at its top in corner 67 of container 61 at distal end 81 of protrusion 77. In this case it is positioned so that a thief could only fit two or three fingers into container 61 and could not reach the device 73, thus being deterred from stealing the container.

Figure 7:
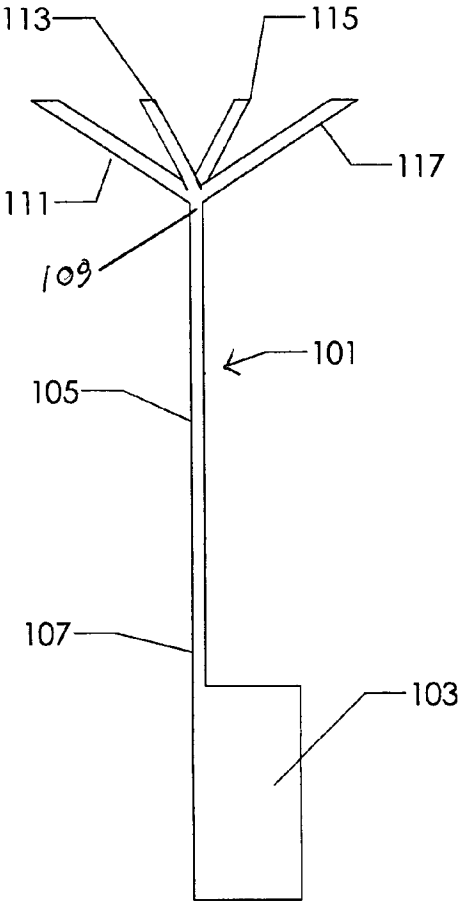
FIG. 7 is a front view of another embodiment of the present invention container-insertable anti-theft device with four separate top segments.

FIG. 7 is a front view of another embodiment of the present invention container-insertable anti-theft device 101 with four separate top segments 111, 113, 115 and 117 to create a spider spread. These segments are connected to distal end 109 of elongated protrusion member 105. Proximal end 107 of member 105 is connected to or is integrally formed with main housing 103. Main housing 103 includes an EAS tag.

Figure 8:
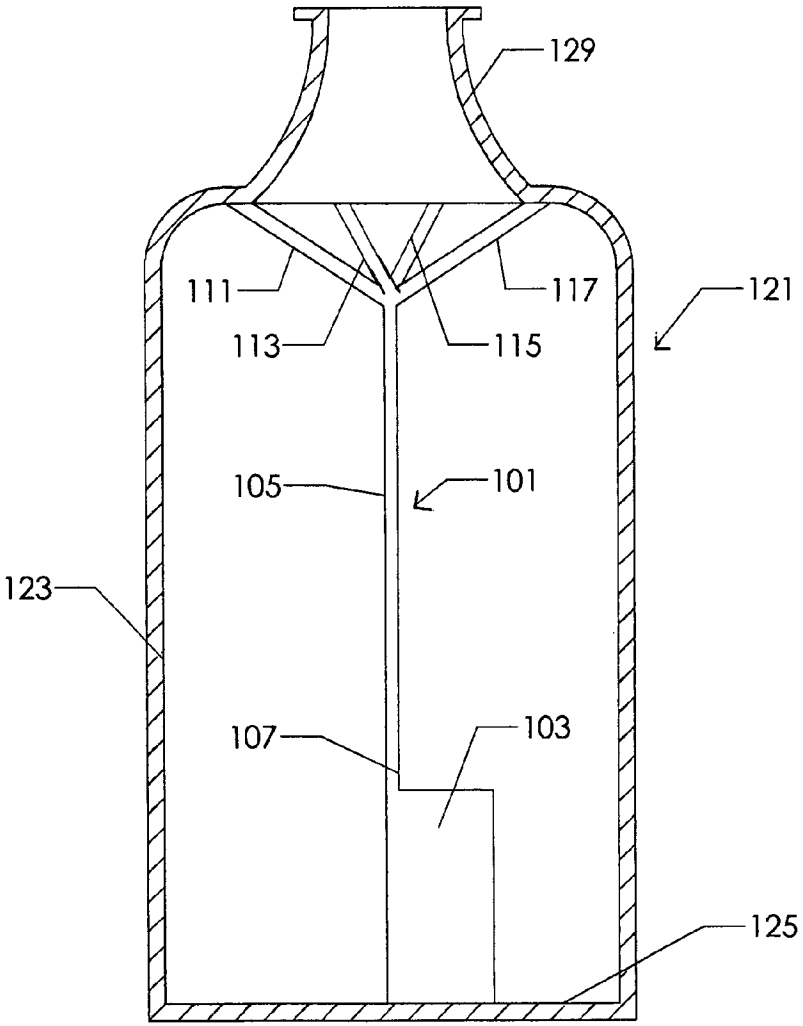
FIG. 8 is a cut front view of another embodiment of the present invention, in this case, a present invention system with a container and a container-insertable anti-theft device inserted therein, wherein the device is the one shown in FIG. 7.

FIG. 8 is a cut front view of another embodiment of the present invention, in this case, a present invention system with a container 121 and a container-insertable anti-theft device inserted therein, wherein the inserted device is the device 101 shown in FIG. 7 and described above. Container 121 has sidewalls 123, bottom 125 and open neck 129, and may be any similar container. Device 101 has been squeezed at its top segments and inserted into neck 129 of container 121 down to bottom 125 and released so as to lodge therein as shown.

Figure 9:
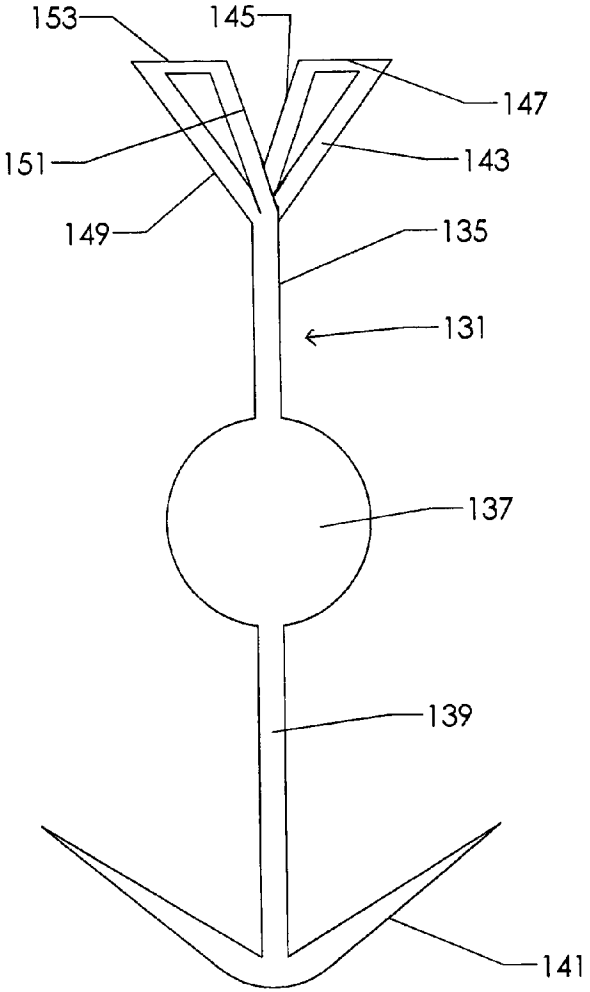
FIG. 9 is a front view of another embodiment of the present invention container-insertable anti-theft device with a bottom flexible cornering wedge.

FIG. 9 is a front view of another embodiment of the present invention container-insertable anti-theft device 131. Device 131 has a central main housing 137 with an EAS marker and has a top protrusion 135 and a bottom protrusion 139. Top protrusion 135 has two sets of segments 143 and 145, and 149 and 151, each connected by cross member 147 and 153, respectively. Bottom protrusion 139 has a flexible with a bottom flexible cornering wedge 141 to help keep the bottom of the device in a container corner.

Figure 10:
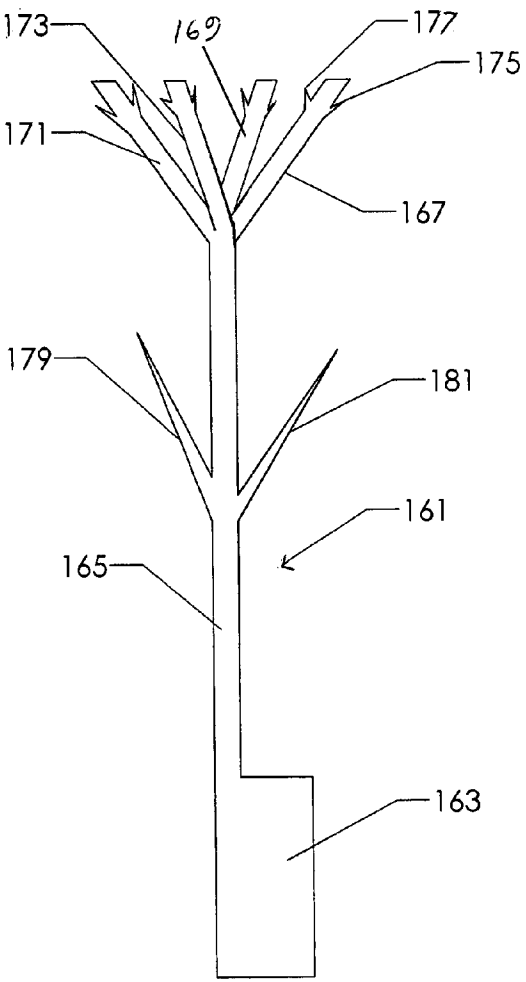
FIG. 10 is a front view of another embodiment of the present invention container-insertable anti-theft device with discouraging spike and barb components.

FIG. 10 is a front view of another embodiment of the present invention container-insertable anti-theft device 161. It includes a main housing 163 with an EAS tag and an elongated protrusion 165 with discouraging spike components 179 and 181. Further, there are four spider segments 167, 169, 171 and 173, and each has barb components, such as barbs 175 and 177. This embodiment is very useful in non-food containers, such as motor oil and pesticides, where blood from a punctured would-be thief's finger won't affect the product.

Figure 11:
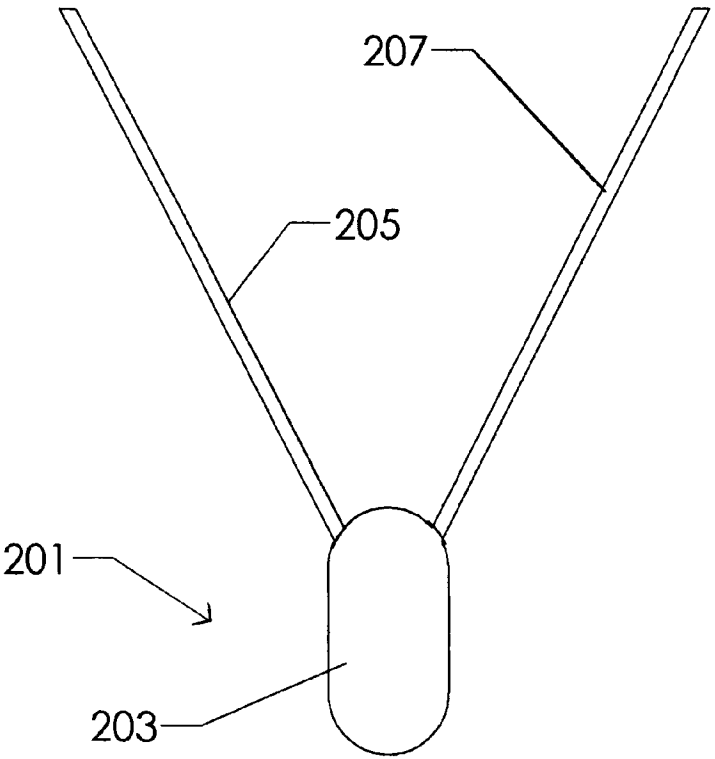
FIG. 11 is a front view of another embodiment of the present invention container-insertable anti-theft device with two separate elongated protrusions; and, FIG. 12 is a front view of another embodiment of the present invention container-insertable anti-theft device with three separate elongated protrusions.

FIG. 11 is a front view of another embodiment of the present invention container-insertable anti-theft device 201. It has a main housing 203 with an EAS security element and has two separate elongated protrusions 205 and 207. As with those described above, a squeeze, insert and release insertion method is used to lodge device 201 in its fitted container.

Figure 12:
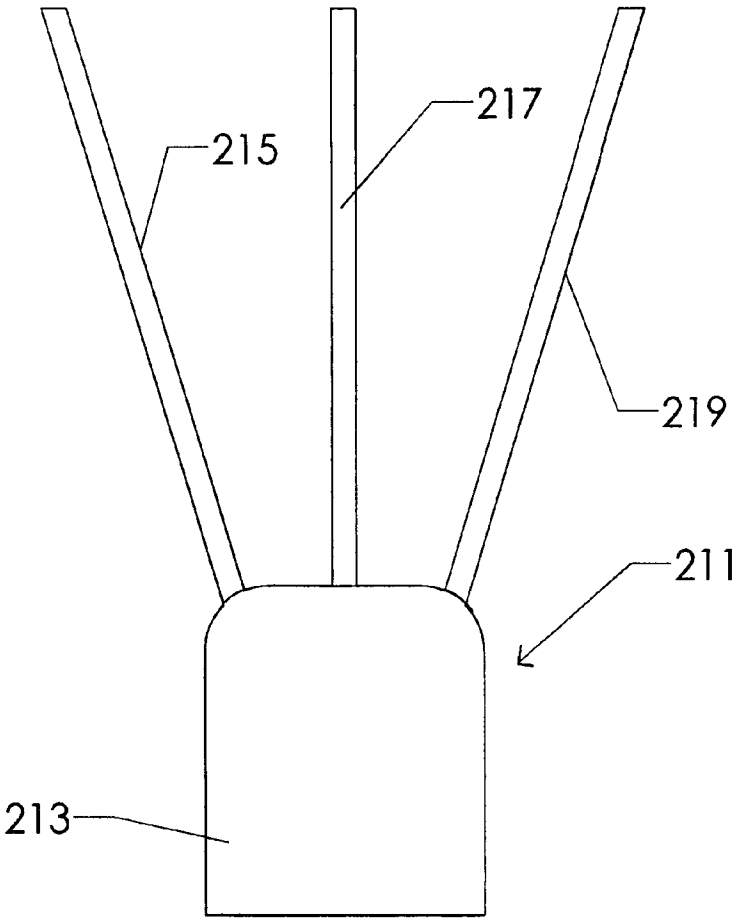

FIG. 12 is a front view of another embodiment of the present invention container-insertable anti-theft device 211. It has a main housing 213 with an EAS security element and has three separate elongated protrusions 215, 217 and 219. As with those described above, a squeeze, insert and release insertion method is used to lodge device 211 in the container for which it was designed.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A container-insertable anti-theft device, which comprises:

a main housing containing an electronic article surveillance marker, said main housing being waterproof; and at least one elongated protrusion extending from said main housing, said elongated protrusion being flexible and having a length equal to at least the longest dimension of said main housing, wherein said at least one elongated protrusion has a proximal end connected to said main housing and has a distal end positioned away from said main housing, said distal end having at least two at least partially non-parallel segments extending therefrom away from said main housing.

2. The container-insertable anti-theft device of claim 1 wherein said at least one elongated protrusion is at least two elongated protrusions.

3. The container-insertable anti-theft device of claim 1 wherein there is one elongated protrusion.

4. The container-insertable anti-theft device of claim 1 wherein said elongated protrusion and said at least two segments are arranged in a Y-shape.

5. The container-insertable anti-theft device of claim 1 wherein there are three segments.

6. The container-insertable anti-theft device of claim 5 wherein said three segments include one segment being a linear extension of and in the same plane as said one elongated protrusion.

7. The container-insertable anti-theft device of claim 1 wherein said at least one elongated protrusion has a length equal to at least twice the longest dimension of said housing.

8. The container-insertable anti-theft device of claim 1 wherein there are at least four elongated protrusions extending from said main housing.

9. The container-insertable anti-theft device of claim 8 wherein said four elongated protrusions are symmetrically arranged to form a spider catch.

10. A container and container-insertable anti-theft device, which comprises:

a) a container for strong flowable material, said container having a hollow body, a pour orifice and a closure for said pour orifice, said container having a maximum internal diagonal dimension; and, b) a container-insertable anti-theft device which comprises:

a main housing containing an electronic article surveillance marker, said main housing being waterproof and having a first predetermined length; and at least one elongated protrusion, said at least one elongated protrusion being flexible and having a second predetermined length, where the sum of the predetermined lengths of said main housing and said at least one elongated protrusion is greater than said maximum internal diagonal dimension of said container, such that said container-insertable anti-theft device may be flexed and force-fitted into a maximum internal diagonal of said container, locking it therein so as to deter easy removal therefrom.

11. The container and container-insertable anti-theft device of claim 10 wherein said at least one elongated protrusion is at least two elongated protrusions.

12. The container and container-insertable anti-theft device of claim 10 wherein there is one elongated protrusion.

13. The container and container-insertable anti-theft device of claim 10 wherein there is one elongated protrusion and said one elongated protrusion has a proximal end and a distal end positioned away from said main housing, said distal end having at least two partially non-parallel segments extending therefrom away from said main housing.

14. The container and container-insertable anti-theft device of claim 13 wherein said elongated protrusion and said at least two segments are arranged in a Y-shape.

15. The container and container-insertable anti-theft device of claim 13 wherein there are three segments.

16. The container and container-insertable anti-theft device of claim 15 wherein said three segments include one segment being a linear extension of and in the same plane as said at one elongated protrusion.

17. The container and container-insertable anti-theft device of claim 10 wherein said at least one elongated protrusion has a length equal to at least the longest dimension of said housing.

18. The container and container-insertable anti-theft device of claim 10 wherein there are at least four elongated protrusions extending from said main housing.

19. The container and container-insertable anti-theft device of claim 18 wherein said four elongated protrusions are symmetrically arranged to form a spider catch.

* * * * *